United States Patent [19]

Lucius

[11] Patent Number: 4,640,262

[45] Date of Patent: Feb. 3, 1987

[54] HEATER, ESPECIALLY A HEATER FOR VEHICLES

[75] Inventor: Werner Lucius, Starnberg, Fed. Rep. of Germany

[73] Assignee: Webasto-Werk W. Baier GmbH & Co., Fed. Rep. of Germany

[21] Appl. No.: 643,305

[22] Filed: Aug. 22, 1984

[30] Foreign Application Priority Data

Oct. 15, 1983 [DE] Fed. Rep. of Germany ..... 3337601

[51] Int. Cl.[4] ..... F24H 3/02

[52] U.S. Cl. ..... 126/110 B; 126/110 R; 237/12.3 C; 431/350

[58] Field of Search ..... 431/117, 278, 284, 354, 431/350; 237/12.3 C; 126/110 R, 116 R, 110 B

[56] References Cited

U.S. PATENT DOCUMENTS

| | | | |
|---|---|---|---|
| 2,240,161 | 4/1941 | Mueller | 431/114 |
| 2,879,837 | 3/1959 | Downs | 431/354 |
| 4,395,225 | 7/1983 | Mittmann | 431/62 |

FOREIGN PATENT DOCUMENTS

| | | | |
|---|---|---|---|
| 975176 | 9/1961 | Fed. Rep. of Germany . | |
| 1803815 | 5/1970 | Fed. Rep. of Germany | 431/114 |
| 2552265 | 6/1977 | Fed. Rep. of Germany | 431/114 |
| 3010078 | 10/1981 | Fed. Rep. of Germany | 431/114 |
| 1556733 | 11/1979 | United Kingdom | 431/114 |

*Primary Examiner*—Henry Bennett

*Attorney, Agent, or Firm*—Sixbey, Friedman & Leedom

[57] ABSTRACT

A heater, especially a fuel-operated vehicle heater, is provided with a cylindrical insert that supports the flame in a combustion pipe delimiting the combustion chamber of the heater. The insert is arranged in such a way that an annular space is formed between the inside wall of the combustion pipe and the outer wall of the insert by the insert being located concentrically in the combustion pipe so as to project into the combustion chamber. This insert permits a concentration of the flame in the combustion chamber in the proximity of the burner of the heater, resulting in a burning under more favorable conditions and in a more complete burning.

19 Claims, 1 Drawing Figure

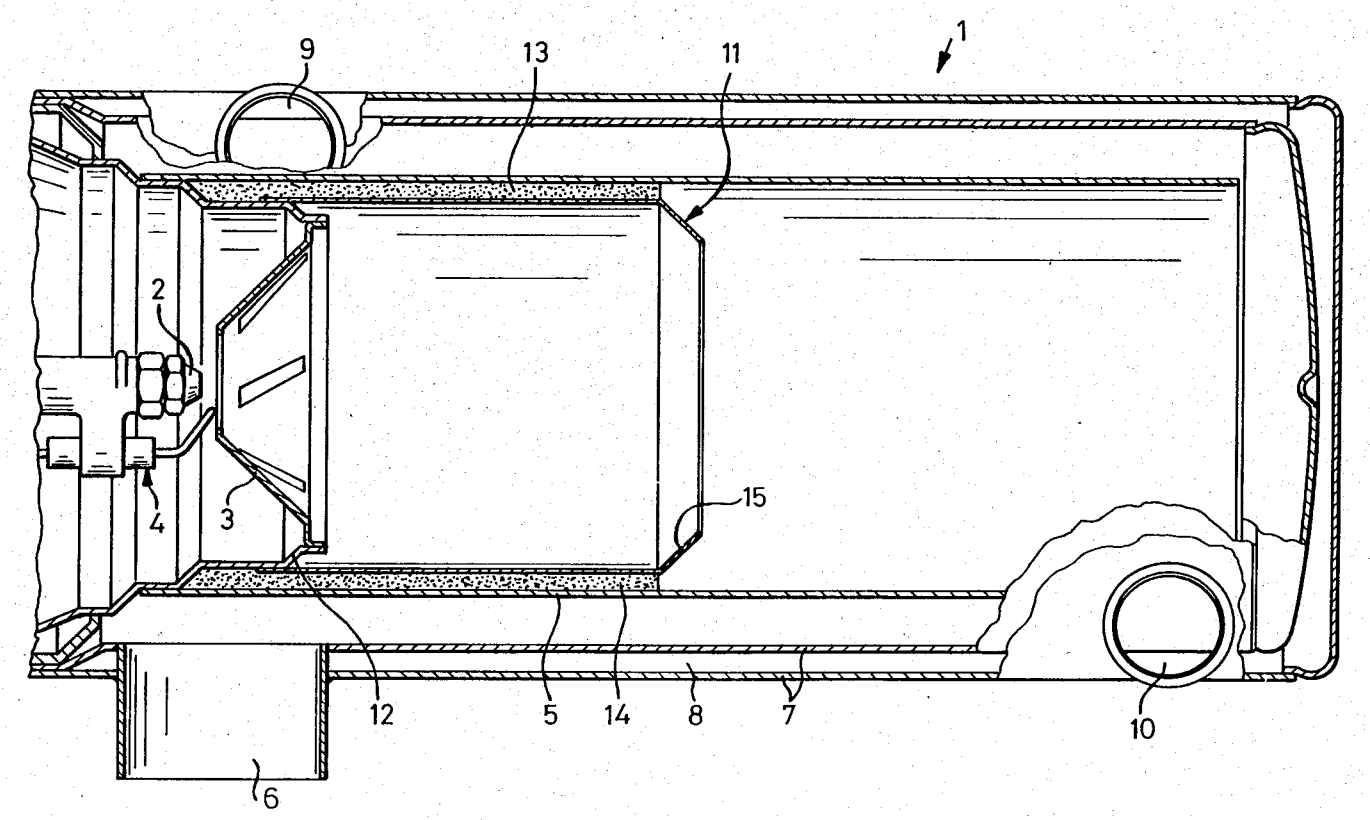
1
2
3
4
5
6
7
8
9
10
11
12
13
14
15

HEATER, ESPECIALLY A HEATER FOR VEHICLES

BACKGROUND SUMMARY OF THE INVENTION

This invention relates to a heater, especially a heater for vehicles, having a mixture enrichment unit, an ignition device and a burner having a nozzle and a vorticization element, said burner also having a combustion chamber formed by a combustion pipe, from where the burned gases are directed to an exhaust-gas outlet in the heat exchange relationship with a heating medium.

Heaters of the above-mentioned type, which are also called fuel-operated heaters, are generally known. Heaters of this type can be further characterized concerning the provided type of burner, such as a low-pressure burner, a rotational atomizing burner and a high-pressure burner, where a nozzle and a vorticization element are provided.

On the basis of German Pat. No. 30 10 078 and corresponding U.S. Pat. No. 4,395,225, a liquid-fuel-operated burner for heating devices is known having a low-pressure atomizer. In order to achieve an automatic temperature-dependent control of the total amount of primary air traveling through the burner in an especially simple, space-saving and reliable manner, a toroidal chamber is provided in the feeding pipe for the primary supplementary air and in said toroidal chamber, a bimetallic ring is provided forming an air valve and controlling the air passage as a function of the temperature.

On the basis of German Auslegeschrift No. 25 52 265 and corresponding British Pat. No. 1,556,733, a rotational atomizing burner is known, for example, that is designed in such a way that an arrangement of charges is achieved that produces a relatively rich mixture only in the area of the ignition zone, i.e. the area of the plug, in order to ensure a secure ignition of said mixture. In the burning chamber, a thin walled and largely self-supporting lining plate is provided that surrounds the rotor at a distance, is penetrated by the ignition plug and is heated very rapidly by the ignition flame of the outlet side of the burner due to a circumferential entrainment of the fuel, so that it acts as an evaporator and contributes very significantly to an enrichment and an increase of the ignitability of fuel-air mixture where it is lean.

From German Offenlenungsschift No. 18 03 815, an arrangement on a combustion chamber for avoiding coking is known, where in the area of the mixture-enrichment zone or of the burning space, a heat pipe is arranged that is preferably formed as an annular cylinder. This heat pipe constitutes a heat-conducting and heat-compensating device. Such a heat pipe is formed by a hollow metallic part containing a material having a capillary effect, such as a copper fiber, and a small amount of liquid. When the heat pipe is heated, the liquid evaporates and, by means of the capillary effect, distributes the heat evenly over the whole surface of the heat pipe, so that the temperature gradient is negligibly small. By means of this heat pipe, the combustion chamber, over its whole length, is kept at an evenly high temperature in order to avoid coking and to achieve a blue burning of the preferably liquid fuel.

German Pat. No. 975 176 discloses a heating device for motor vehicles, especially motor vehicles with an underfloor or rear engine, where the combustion chamber, by means of a constricting ring, is subdivided into a combustion chamber and a post-combustion chamber.

In the case of all these known heaters, achieving optimized combustions still remains a problem, especially in view of the $CO_2$ and CO values of the exhaust gases and the smoke spot number; said problem being all the more urgent, the more exhaust-gas emission values of such units are restricted by governmental regulations to increasingly lower values and the $CO_2$-value in this case corresponds largely to the stoichiometric combustion. If these exhaust gas emission values are to be reduced, this has only been possible by accepting a less favorable burning efficiency of the heater. Another difficulty, in the case of the previously known heaters, is the noise emission, where a need exists to obtain a noise emission that is as low as possible.

The invention, therefore, has a primary object of developing a heater of the above-mentioned type in such a way that, a noise emission that is as low as possible can be obtained, yet an extremely favorable efficiency of the heater and of the combustion can be achieved, along with optimization of the combustion values, especially the $CO_2$-values, the CO-values and the smoke spot number.

According to a preferred embodiment of the invention, a heater is developed for this purpose, and especially a heater for vehicles, through the use of an insert for supporting the flame within the combustion pipe that forms an annular space arranged concentrically along the combustion pipe and projecting into the combustion chamber.

More particularly, the insert supporting the flame in the combustion pipe for the combustion chamber should be as thin and short as possible, so that it has a very small mass of its own. This insert has the effect that it has a very small mass of its own. This insert has the effect that the flame and the heat generated by it is concentrated in a space that is as small as possible. Consequently, the combustion mixture evaporation is increased, especially in this area or space, so that very favorable burning conditions and a significantly more complete combustion than previously was obtained is achieved. In fact, for example, the $CO_2$-value of the burned gas can be increased to about 15%, which ensures a better efficiency during combustion.

When the insert has only a small mass of its own, it can be heated to operating temperature very rapidly, and it also cools off very rapidly after the heater is turned off. As a result, when the heater is turned on, a very short smoke phase is achieved so that the heater according to the invention, also, has a low smoke spot number at ignition and no further soot is produced during operation.

In a surprising manner, the insert according to the invention, which is formed in an uncomplicated manner, can result in a significant improvement in the case of heaters of the mentioned type, with respect to the efficiency as well as to the exhaust-gas emission values.

Favorable results may, especially, be achieved when the length of the insert, in the longitudinal direction of the combustion pipe is selected in such a way that it is approximately equal to the diameter of the insert. In the case of these dimensions, it is not only ensured that the length of the insert is dimensioned to be as short as possible, but also that the space formed by the insert, where the flame is concentrated, has optimal dimensions in regard to achieving complete combustion.

For a further improvement of the concentration of the flame in the space formed by the insert, the insert in the area of its downstream, open, end has a narrowing of its diameter. The ratio of the diameter of the narrowing to the diameter of the insert is preferably about 1:1.25.

Preferably, the annular space between the insert and the combustion pipe is filled with a heat insulating material so that the insert, by means of the insulation, is thermally insulated from exhaust gases flowing along the exterior of the combustion pipe to the exhaust-gas outlet, especially in the proximity of the burner, in order to avoid a heating of the exhaust gases in this area. This results in a lowering of the exhaust gas temperature by up to 25° C., and improves the efficiency with respect to fuel-engineering of such a heater even further.

In the case of a high-pressure burner having a nozzle and a vorticizing element, there is the additional advantage that the insert supporting the flame makes it possible that the nozzle tolerances may have a more extensive dispersion range and may therefore have a greater dispersion in the spraying pattern.

The measures according to the invention also permit a reduction of the noise emission of such a heater, and a more quietly operable heater is especially advantageous in regard to motor vehicle heaters when the passenger area is to have as little noise as possible.

In the case of certain burners intended for household purposes, for example, where the heat transfer to the heating medium takes place in a manner that is different than in the case of the described embodiment, the combustion pipe may be detached from the insert, so that only the insert is provided.

These and further objects, feature and advantages of the present invention will become more obvious from the following description when taken in connection with the accompanying drawings which show, for purposes of illustration only, a single embodiments in accordance with the present invention.

BRIEF DESCRIPTION OF THE DRAWING

The sole FIGURE of the drawing shows a sectional view of a heater according to a preferred embodiment of the invention having a high-pressure burner with a nozzle and a vorticization element.

DETAILED DESCRIPTION OF THE PREFERRED EMBODIMENT

In the only FIGURE, the heater, as a whole, has the reference numeral 1. The heater contains a high-pressure burner having a nozzle 2 and a vorticization element 3 that is axially spaced a short distance downstream of the nozzle. An ignition device 4 is also provided for igniting the fuel mixture in the proximity of the mouth of the nozzle. A combustion chamber is formed by combustion pipe 5, and the exhaust gases, after a rerouting at the discharge end of the combustion pipe (end opposite the burner), are discharged through exhaust outlet 6. The combustion pipe 5 is surrounded by a double-shell arrangement which defines an annular space 8 through which a fluid heating medium, such as water, is circulated. The heating medium enters via an inlet 9 and is discharged via an outlet 10. This heating medium is heated by the heat emitted by the combustion pipe 5 and the reversed flow of the exhaust gas which travels along the inner shell 7, when the burner is operating.

An insert that has the reference numeral 11 supports the flame in the combustion pipe 5 and is arranged concentrically thereon, as shown in the figure. By supporting the flame it is meant that the intensity of the flame is reinforced or, conversely, tendencies of the flame to extinguish reduced. The insert 11 is, advantageously fastened in the area of the burner side at a mounting support 12 of the vorticization element 3. It is also advantageous to use an insert 11 that is cylindrical, like the combustion pipe 5. An annular space 13 exists between the inner wall of the combustion pipe 5 and the outer wall of the insert 11. The annular space is preferably filled with a heat insulating material (such as a ceramic padding) in order to prevent heating of the exhaust gas flowing to the exhaust outlet 6, especially in the proximity of the burner, i.e., the vorticization element 3. This results in a lowering of the temperature of the exhaust gas by up to 25° C.

The insert 11, at its downstream end (i.e., the end that is directed away from the burner), has a narrowing 15 of its diameter which, advantageously, is formed as a frusto-conical constriction. The length of insert 11 is, preferably, approximately equal to its diameter, and the ratio of the diameter of the constriction to the diameter of the insert is, preferably about 1:1.25.

Although the invention has been explained by means of a preferred embodiment in connection with a heater having a nozzle 2 and a vorticization element 3, so that the burner is a so-called high-pressure burner, the invention may also be carried out in the case of other types of burners, such as a low-pressure burner or a rotational atomizing burner.

The insert 11 has the effect that the flame generated by the burner (the burner being formed by the nozzle 2 and the vorticization element 3, in conjunction with the ignition device 4) is concentrated in the space enclosed by the insert 11, said space being significantly smaller than the burning chamber formed by the combustion pipe 5, so that the burning of the fuel mixture can take place under much more favorable conditions and, consequently, the efficiency of such a heater can be improved. Since the insert 11 can be made of a thin plate, it is inexpensive to make and also has a small mass of its own so that it can be heated rapidly to operating temperature and can rapidly cool-off again after the heater 1 is switched off. As a result, especially after the switching-on of the heater 1, a very short smoke phase is obtained. In addition, the design of the heater according to the invention having the insert 11 permits a significant muffling of noises so that the heater 1 not only is efficient, in which case more favorable waste gas emission values are obtained without a reduction of the efficiency of the heater, but operates quietly as well.

While I have shown and described a single embodiment in accordance with the present invention, it is understood that the same is not limited thereto, but is susceptible of numerous changes and modifications as shown to those skilled in the art, and I, therefore, do not wish to be limited to the details shown and described herein, but intend to cover all such changes and modifications as are encompassed by the scope of the appended claims.

I claim:

1. A heater, especially for a fuel operated vehicle heater, of the type having a fuel enrichment unit, an ignition device, a burner comprised of a nozzle and a vorticization element, and a combustion chamber defined by a combustion pipe from which exhaust gases are guided to an exhaust outlet in a reverse flow along an outer wall of the combustion pipe in heat exchange relationship to a heating medium, wherein a cylindrical insert is provided as a means for supporting the flame by concentration thereof in the combustion pipe, said insert being connected to the burner in a manner forming an annular space extending along the full length of the insert between an outer circumferential surface of the cylindrical insert and an inner surface of a circumferential wall of the combustion pipe by being arranged concentrically in the combustion pipe and projecting into the combustion chamber defined by the combustion pipe from the area of the vorticization element.

2. A heater according to claim 1, wherein the length of the insert corresponds approximately to its diameter.

3. A heater according to claim 2, wherein the diameter of the insert is provided with a constriction in the area of its downstream end.

4. A heater according to claim 3, wherein a ratio of the diameter of the constriction to the diameter of the insert is about 1:1.25.

5. A heater according to claim 4, wherein the constriction is formed by a frusto-conical shaping of the downstream end of the insert.

6. A heater, especially for a fuel operated vehicle heater, of the type having a fuel enrichment unit, an ignition device, a burner comprised of a nozzle and a vorticization element, and a combustion chamber defined by a combustion pipe from which exhaust gases are guided to an exhaust outlet in a reverse flow along an outer wall of the combustion pipe in a heat exchange relationship to a heating medium, wherein a cylindrical insert is provided as a means for supporting the flame by concentration thereof in the combustion pipe, said insert being connected to the burner in a manner forming an annular space between an outer circumferential surface of the cylindrical insert and an inner surface of a circumferential wall of the combustion pipe by being arranged concentrically in the combustion pipe and projecting concentrically into the combustion chamber defined by the combustion pipe from the area of the vorticization element, wherein the annular space formed between the insert and the combustion pipe is filled with a heat-insulating material.

7. A heater according to claim 6, wherein the heat-insulating material is a ceramic padding.

8. A heater according to claim 6, wherein the insert is fastened to the support of the vorticization element and surrounds it.

9. A heater according to claim 1, wherein the diameter of the insert is provided with a constriction in the area of its downstream end.

10. A heater according to claim 9, wherein the constriction is formed by a frusto-conical shaping of the downstream end of the insert.

11. A heater according to claim 10, wherein a ratio of the diameter of the constriction to the diameter of the insert of 1:1.25.

12. A heater according to claim 1 wherein the insert is fastened to the support of the vorticization element and surrounds it.

13. A heater according to claim 12, wherein the diameter of the insert is provided with a constriction in the area of its downstream end.

14. A heater according to claim 13, wherein the constriction is formed by a frusto-conical shaping of the downstream end of the insert.

15. A heater according to claim 14, wherein a ratio of the diameter of the constriction to the diameter of the insert is 1:1.25.

16. A heater according to claim 12, wherein the length of the insert corresponds approximately to its diameter.

17. A heater according to claim 6, wherein said insert is formed of metal.

18. A heater according to claim 1, wherein said annular space extends axially toward said nozzle, at least as far as a point of mounting of the insert in the vicinity of said vorticization element.

19. A heater according to claim 1, wherein said ignition device is situated on a first side of said vorticization element and said cylindrical insert extends into said combustion chamber at a second, opposite, side of said vorticization element.

* * * * *